US007727379B2

(12) United States Patent
Adams et al.

(10) Patent No.: US 7,727,379 B2
(45) Date of Patent: Jun. 1, 2010

(54) PROCESS TO CONTINUOUSLY PREPARE TWO OR MORE BASE OIL GRADES AND MIDDLE DISTILLATES

(75) Inventors: Nicholas James Adams, Rosehill (AU); Harmannus Julius Hegge, Rotterdam (NL); Laurent Georges Huve, Amsterdam (NL); Kevin John Anthony Polder, Petit Couronne (FR); Wiecher Derk Evert Steenge, Amsterdam (NL)

(73) Assignee: Shell Oil Company, Houston, TX (US)

( * ) Notice: Subject to any disclaimer, the term of this patent is extended or adjusted under 35 U.S.C. 154(b) by 294 days.

(21) Appl. No.: 10/591,259

(22) PCT Filed: Mar. 1, 2005

(86) PCT No.: PCT/EP2005/050860

§ 371 (c)(1),
(2), (4) Date: Aug. 31, 2006

(87) PCT Pub. No.: WO2005/085394

PCT Pub. Date: Sep. 15, 2005

(65) Prior Publication Data

US 2007/0181461 A1 Aug. 9, 2007

(30) Foreign Application Priority Data

Mar. 2, 2004 (EP) ..... 04290570

(51) Int. Cl.
*C10G 65/00* (2006.01)
*C10G 69/00* (2006.01)

(52) U.S. Cl. ..... 208/58; 208/18; 208/19; 208/27; 208/46; 208/49; 208/59; 208/92; 208/97; 208/111; 585/737; 585/739

(58) Field of Classification Search ..... 208/18, 208/19, 27, 46, 49, 58, 59, 92, 97, 111; 585/737, 585/739
See application file for complete search history.

(56) References Cited

U.S. PATENT DOCUMENTS 3,876,522 A 4/1975 Campbell et al. ..... 208/58

(Continued)

FOREIGN PATENT DOCUMENTS

CA 230659 5/1923

(Continued)

*Primary Examiner*—Glenn Caldarola
*Assistant Examiner*—Prem C. Singh
(74) *Attorney, Agent, or Firm*—Charles W. Stewart

(57) ABSTRACT

Process to prepare simultaneously two or more base oil grades and middle distillates from a mineral crude derived feed, in particular a de-asphalted oil or a vacuum distillate feed or their mixtures, by performing the following steps: (a) hydrocracking the mineral crude derived feed, thereby obtaining an effluent; (b) distillation of the effluent as obtained in step (a) into one or more middle distillates and a full range residue boiling substantially above 340° C., (c) catalytically dewaxing the full range residue by contacting the residue with a dewaxing catalyst comprising a zeolite of the MTW type and a Group VIII metal, thereby obtaining a dewaxed oil; (d) isolating by means of distillation two or more base oil grades from the dewaxed oil obtained in step (c); and (e) isolating a dewaxed gas oil from the dewaxed-oil obtained in step (c); wherein the dewaxed oil as obtained in step (c) comprises between 10 and 40 wt % of a dewaxed heavy gas oil boiling for more than 70 wt % between 370 and 400° C.

20 Claims, 1 Drawing Sheet

U.S. PATENT DOCUMENTS

| | | | | |
|---|---|---|---|---|
| 4,574,043 | A | 3/1986 | Chester et al. | 208/59 |
| 4,605,488 | A | 8/1986 | Chester et al. | 208/78 |
| 4,851,109 | A | 7/1989 | Chen et al. | 208/58 |
| 4,859,311 | A | 8/1989 | Miller | 208/89 |
| 5,053,373 | A | 10/1991 | Zones | 502/64 |
| 5,252,527 | A | 10/1993 | Zones | 502/64 |
| 6,576,120 | B1 | 6/2003 | Van Ballegoy et al. | 208/119 |
| 6,583,186 | B2 * | 6/2003 | Moore, Jr. | 518/700 |
| 6,663,768 | B1 * | 12/2003 | Miller | 208/27 |
| 7,347,928 | B2 * | 3/2008 | Van Beijnum et al. | 208/18 |
| 2004/0001416 | A1 | 1/2004 | Suzuki et al. | 369/75.1 |

FOREIGN PATENT DOCUMENTS

| | | |
|---|---|---|
| EP | 272729 | 6/1988 |
| EP | 649896 | 4/1995 |
| EP | 699225 | 3/1996 |
| EP | 705321 | 4/1996 |
| EP | 832171 | 4/1998 |
| EP | 994173 | 4/2000 |
| WO | 9410263 | 5/1994 |
| WO | 9718278 | 5/1997 |
| WO | 9723584 | 7/1997 |
| WO | 9802503 | 1/1998 |
| WO | 0027950 | 5/2000 |
| WO | 0229511 | 2/2002 |
| WO | 0250213 | 6/2002 |
| WO | 02070627 | 9/2002 |
| WO | 02070630 | 9/2002 |
| WO | WO03093392 | 11/2003 |

* cited by examiner

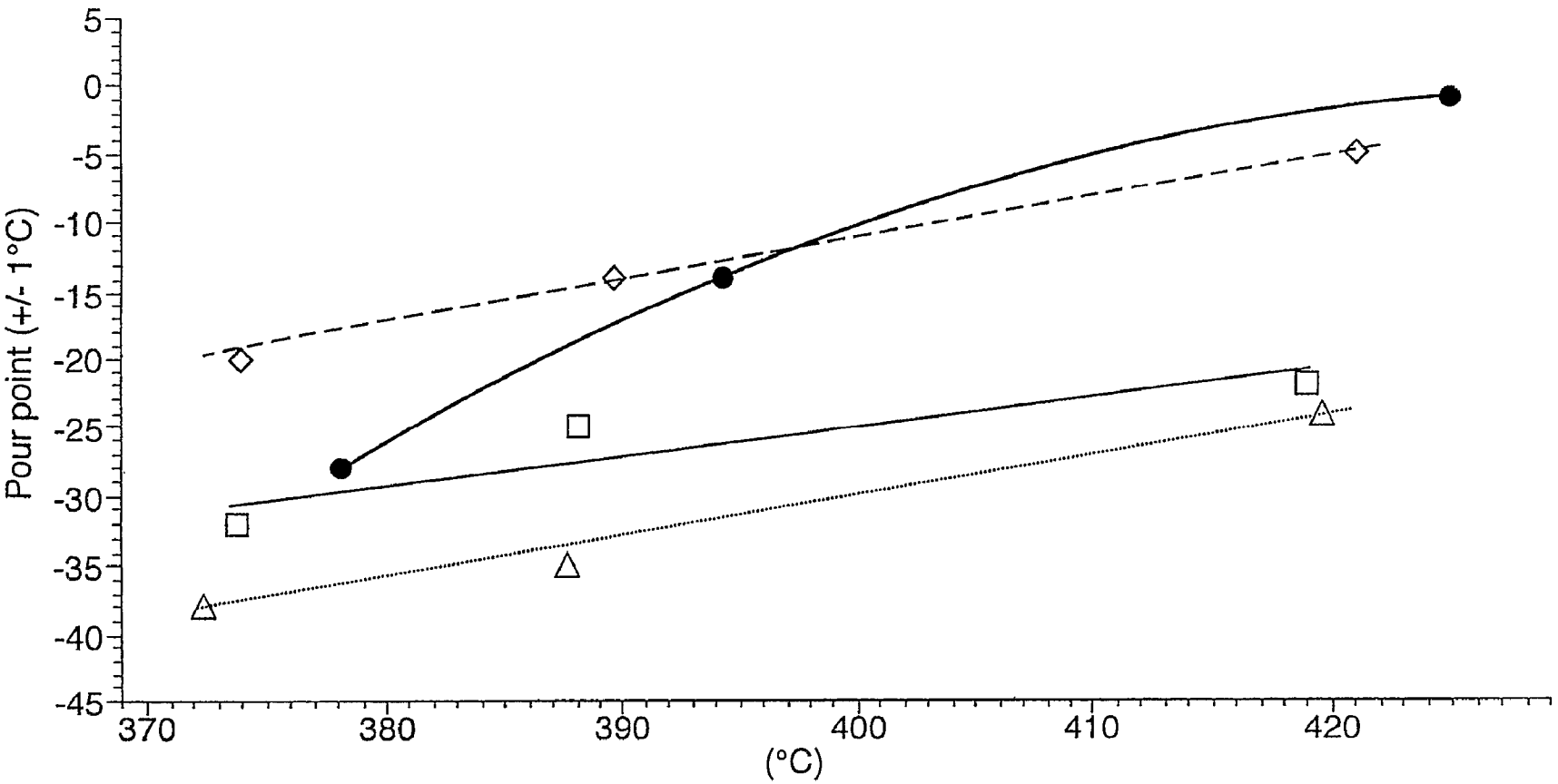
Pour point (+/- 1°C)
5
0
-5
-10
-15
-20
-25
-30
-35
-40
-45
370
380
390
400
410
420
(°C)

PROCESS TO CONTINUOUSLY PREPARE TWO OR MORE BASE OIL GRADES AND MIDDLE DISTILLATES

PRIORITY CLAIM

The present application claims priority of European Patent Application No. 04290570.3 filed 2 Mar. 2004.

FIELD OF INVENTION

The invention relates to a process to continuously prepare two or more base oil grades and middle distillates from a mineral crude derived feed.

BACKGROUND OF THE INVENTION

WO-A-0250213 describes a process wherein different base oil grades are made in a so-called blocked-out mode. In this process a bottoms fraction of a hydrocracking process, which thus also yields middle distillates as products, is separated into various base oil precursor fractions. These fractions are subsequently catalytically dewaxed one after the other using a platinum-ZSM-5 based catalyst.

WO-A-9718278 discloses a process wherein up to 4 base oil grades, e.g. a 60N, 100N and 150N, are prepared starting from the bottoms fraction of a hydrocracker. In this process the bottoms fraction is first fractionated in a vacuum distillation into 5 fractions of which the heavier 4 fractions are further processed to different base oil grades by first performing a catalytic dewaxing followed by a hydrofinishing step.

A disadvantage of the above processes is that the process is not continuous. In other words the base oil grades are not made at the same time but sequential. This requires tankage for the intermediate products as obtained when the hydrocracker bottoms are fractionated and are awaiting their turn to be catalytically dewaxed. A further disadvantage are the mode switches which result in heating up of equipment and cooling of equipment causing deterionation of equipment. The mode switches also result in intermediate off-spec product every time a new grade is being processed. These slops need to be reprocessed or disposed off which is disadvantageous.

EP-A-649896 discloses a process to prepare a residue comprising a base oil by means of a process involving a hydrotreating step and a hydrocracking step on a heavy petroleum feedstock. The hydroprocessing steps yield a product from which middle distillates and a bottoms fraction (residue) are obtained. This bottoms fraction is subsequently solvent dewaxed to a single grade base oil grade.

WO 02/070627 discloses a process to prepare two or more base oil grades and a gas oil from a Fischer-Tropsch derived feed, i.e. not from a mineral crude derived feed.

EP-A-0 994 173 relates to a process for making an automatic transmission fluid composition.

U.S. Pat. No. 6,576,120 relates to a process for the catalytic dewaxing of a hydrocarbon feed containing waxy molecules.

WO-A-9723584 discloses a process wherein the bottoms fraction of a fuels hydrocracker is subjected to a catalytic dewaxing step. The dewaxed oil is partly recycled to the hydrocracking step and partly obtained as the lubricating base oil.

A disadvantage of the above process as described in WO-A-9723584 is that if more than one base oil grade is isolated from the dewaxed oil a large pour point distribution occurs. In other words the resulting the lower viscous base oil grades will have a too low pour point. This pour point give away, or difference with the desired value, is indicative for yield loss of said lower viscous base oil grade.

SUMMARY OF THE INVENTION

One object of the present invention is to provide a process, which is capable of preparing two or more base oil grades simultaneously and wherein their respective pour points are more close to the desired values.

It is another object of the present invention to provide an alternative process to prepare two or more base oil grades simultaneously from a mineral crude derived feed.

One or more of the above or other objects is achieved according to the present invention by providing the following process.

Process to prepare simultaneously two or more base oil grades and middle distillates from a mineral crude derived feed, in particular a de-asphalted oil or a vacuum distillate feed or their mixtures, by performing the following steps:

(a) hydrocracking the mineral crude derived feed, thereby obtaining an effluent;

(b) distillation of the effluent as obtained in step (a) into one or more middle distillates and a full range residue boiling substantially above 340° C., (c) catalytically dewaxing the full range residue by contacting the residue with a dewaxing catalyst comprising a zeolite of the MTW type and a Group VIII metal, thereby obtaining a dewaxed oil;

(d) isolating by means of distillation two or more base oil grades from the dewaxed oil obtained in step (c); and (e) isolating a dewaxed gas oil from the dewaxed-oil obtained in step (c);

wherein the dewaxed oil as obtained in step (c) comprises between 10 and 40 wt % of a dewaxed heavy gas oil boiling for more than 70 wt % between 370 and 400° C.

Applicants found that when using a catalytic dewaxing catalyst comprising a MTW zeolite type a more equally distributed pour point value was achieved for all the base oil grades as obtained in step (d). Because of this more equal pour point quality of the resulting grades a minimal quality give away will result, which makes this mode of operation attractive. If in contrast a ZSM-5 based dewaxing catalyst was used on such a full range residue as described in WO-A-9723584 a much greater pour point distribution will be observed. In case such a catalyst would be used the lower viscosity grades would have a pour point much lower than required in order to achieve the desired pour point in the remaining higher viscosity base oil grades. The lower than required pour point is a disadvantage because it is indicative for a lower yield of said lower viscosity grade base oil.

Another advantage of processing the full range residue in comparison to the blocked-out mode is that any compounds which are converted in the more heavier base oil grades to compounds boiling just below said grade contribute to the base oil yield just boiling below said heavier grade. In case of a blocked-out mode of operation these compounds boiling just below the desired grade cannot be easily combined with the less viscous base oil.

An even further advantage is that the Applicants surprisingly found that a dewaxing catalyst comprising a zeolite of the MTW type and a Group VIII metal provides not only two or more base oil grades having desirable properties, but also surprisingly high amounts of a heavy gas oil having a surprisingly low pour point.

BRIEF DESCRIPTION OF THE DRAWING

The sole drawing presents the results from the experiments in the examples.

DETAILED DESCRIPTION OF THE INVENTION

The feed to step (a) may be any typical mineral crude derived feed to a hydrocracker. Such feedstocks may be the vacuum gas oil or heavier distillate fractions as obtained when distilling at vacuum conditions the atmospheric residue of a crude mineral oil feedstock. The deasphalted oil as obtained when deasphalting the residue as obtained in said vacuum distillation may also be used as feed. Light and heavy cycle oils as obtained in a fluid catalytic cracking process (FCC), thermally flashed distillate and aromatic rich extracts as for example obtained in solvent extraction process steps in traditional base oil processing may also be used as feed. Mixtures of the above described feeds and optionally other hydrocarbon sources are also suitable as feedstocks. An optional alternative hydrocarbon source which may be blended with the mineral source feedstocks as described above are the, optionally partly isomerised, paraffin waxes as obtained in a Fischer-Tropsch process. The amount of such paraffin wax is preferably not more than 30 wt % in the feed to step (a). Preferably, the feed is 100% mineral crude derived.

In order to be able to prepare the desired quantity of the more viscous base oil grades a relatively heavy feed to step (a) is desired. Preferably a feed is used wherein more than 10 wt %, preferably more than 20 wt % and most preferably more than 30 wt % of the compounds present in said feed boil above 470° C. Suitably less than 60 wt % of the compounds present in the feed boil above 470° C.

Step (a) may be performed at a conversion level of between 15 and 90 wt %. The conversion is expressed in the weight percentage of the fraction in the feed which boils above 370° C. which are converted to products boiling below 370° C. The main products boiling below 370° C. are naphtha, kerosene and gas oil. Examples of possible hydrocracker processes suitable for performing step (a) are described in EP-A-699225, EP-A-649896, WO-A-9718278, EP-A-705321, EP-A-994173 and U.S. Pat. No. 4,851,109.

The operating conditions of a single step hydrocracking process are preferably a temperature in the range of from 350 to 450° C., a hydrogen pressures in the range of from 9 to 200 MPa, more preferably above 11 MPa, a weight hourly space velocities (WHSV) in the range of from 0.1 to 10 kg of oil per liter of catalyst per hour (kg/l/hr), preferably from 0.2 to 5 kg/l/hr, more preferably from 0.5 to 3 kg/l/hr and hydrogen to oil ratios in the range of from 100 to 2,000 liters of hydrogen per liter of oil.

Preferably the hydrocracker is operated in two steps, consisting of a preliminary hydrotreating step followed by a hydrocracking step. In the hydrotreating step nitrogen and sulphur are removed and aromatics are saturated to naphthenes and part of the naphthenes are converted to paraffins by ring opening reactions. In order to improve the yield of the more viscous grade base oils the hydrocracker is more preferably operated by first (i) hydrotreating a hydrocarbon feed at a feed conversion, wherein the conversion, as defined above, of less than 30 wt % and preferably between 5 and 25 wt %, and (ii) hydrocracking the product of step (i) in the presence of a hydrocracking catalyst at such a conversion level that the overall conversion of step (i) and (ii) is between 15 and 90 wt % and preferably between 40 and 85 wt %.

The operating conditions of a hydrotreating step are preferably a temperature in the range of from 350 to 450° C., a hydrogen pressures in the range of from 9 to 200 MPa, more preferably above 11 MPa, a weight hourly space velocities (WHSV) in the range of from 0.1 to 10 kg of oil per liter of catalyst per hour (kg/l/hr), preferably from 0.2 to 5 kg/l/hr, more preferably from 0.5 to 3 kg/l/hr and hydrogen to oil ratios in the range of from 100 to 2,000 liters of hydrogen per liter of oil.

The operating conditions of a hydrocracking step performed in combination with a hydrotreating step are preferably a temperature in the range of from 300 to 450° C., a hydrogen pressures in the range of from 9 to 200 MPa, more preferably above 11 MPa, a weight hourly space velocities (WHSV) in the range of from 0.1 to 10 kg of oil per liter of catalyst per hour (kg/l/hr), preferably from 0.2 to 5 kg/l/hr, more preferably from 0.5 to 3 kg/l/hr and hydrogen to oil ratios in the range of from 100 to 2,000 liters of hydrogen per liter of oil.

The full range residue as prepared by the processes as described above have a very low content of sulphur, typically below 250 ppm or even below 150 ppmw, and a very low content of nitrogen, typically below 30 ppmw.

It has been found that by performing the combined hydrotreating and hydrocracking step as described above a full range residue is obtained which yields a high quantity of the more viscous grade base oil, also referred to as medium machine oil grade, and of acceptable quality with respect to viscosity index. In addition a sufficient quantity of naphtha, kerosine and gas oils are obtained by this process. Thus a hydrocracker process is obtained wherein simultaneously products ranging from naphtha to gas oil and a full range residue is obtained, which full range residue has the potential to yield a medium machine oil base oil grade. The viscosity index of the resulting base oil grades is suitably between 95 and 120, which is acceptable to yield base oils having a viscosity index according to the API Group II specifications. It has been found that the wt % of medium machine oil fraction, which fraction has a kinematic viscosity at 100° C. of above 9 cSt, in the 370° C. plus fraction of the full range residue can be more than 15 wt % and more especially more than 25 wt % if the hydrocracker is operated as described above.

In the context of the present invention terms as spindle oil, light machine oil and medium machine oil will refer to base oil grades having an increasing kinematic viscosity at 100° C. and wherein the spindle oil additionally has a maximum volatility specification. The advantages of the present process are achieved for any group of base oils having such different viscosity requirement and volatility specification. Preferably a spindle oil is a light base oil product having a kinematic viscosity at 100° C. of below 5.5 cSt and preferably above 3.5. The spindle oil can have either a Noack volatility, as determined by the CEC L-40-T87 method, of preferably below 20% and more preferably below 18% or a flash point, as measured according to ASTM D93, of above 180° C. Preferably the light machine oil has a kinematic viscosity at 100° C. of below 9 cSt and preferably above 6.5 cSt and more preferably between 8 and 9 cSt. Preferably the medium machine oil has a kinematic viscosity at 100° C. of below 14 cSt and preferably above 10 cSt and more preferably between 11 and 13 cSt. These base oil grades preferably have a viscosity index of between 95 and 120.

It has been found that in the hydrotreating step (i) the viscosity index of the full range residue and the resulting base oil grades increases with the conversion in said hydrotreating step. By operating the hydrotreating step at high conversion levels of more than 30 wt % viscosity index values for the resulting base oils of well above 120 can be achieved. A disadvantage of such a high conversion in step (i) is however that the yield of medium machine oil fraction will be undesirably low. By performing step (i) at the above described conversion levels an API Group II medium machine oil grade base oil can be obtained in a desired quantity. The minimum conversion in step (i) will be determined by the desired viscosity index, of between 95 and 120, of the resulting base oil grades and the maximum conversion in step (i) is determined by the minimum acceptable yield of medium machine oil grade.

The preliminary hydrotreating step is typically performed using catalyst and conditions as for example described in the above-mentioned publications related to hydrocracking. Suitable hydrotreating catalysts generally comprise a metal hydrogenation component, suitably Group IVB or VIII metal, for example cobalt-molybdenum, nickel-molybdenum, on a porous support, for example silica-alumina or alumina. The hydrotreating catalysts suitably contains no zeolite material or a very low content of less than 1 wt %. Examples of suitable hydrotreating catalysts are the commercial ICR 106, ICR 120 of Chevron Research and Technology Co.; 244, 411, DN3100, DN3110, DN3120, DN3300, DN120, DN190 and DN200 of Criterion Catalyst Co.; TK-555 and TK-565 of Haldor Topsoe A/S; HC-k, HC-P, HC-R and HC-T of UOP; KF-742, KF-752, KF-846, KF-848 STARS and KF-849 of AKZO Nobel/Nippon Ketjen; and HR-438/448 of Procatalyse SA.

The hydrocracking step is preferably a catalyst comprising an acidic large pore size zeolite within a porous support material with an added metal hydrogenation/dehydrogenation function. The metal having the hydrogenation/dehydrogenation function is preferably a Group VIII/Group VIB metal combination, for example nickel-molybdenum and nickel-tungsten. The support is preferably a porous support, for example silica-alumina and alumina. It has been found that a minimum amount of zeolite is advantageously present in the catalyst in order to obtain a high yield of medium machine oil fraction in the full range residue when performing the hydrocracker at the preferred conversion levels as explained above. Preferably more than 1 wt % of zeolite is present in the catalyst. Examples of suitable zeolites are zeolite X, Y, ZSM-3, ZSM-18, ZSM-20 and zeolite beta of which zeolite Y is most preferred. Examples of suitable hydrocracking catalysts are the commercial ICR 220 and ICR 142 of Chevron Research and Technology Co; Z-763, Z-863, Z-753, Z-703, Z-803, Z-733, Z-723, Z-673, Z-603 and Z-623 of Zeolyst International; TK-931 of Haldor Topsoe A/S; DHC-32, DHC-41, HC-24, HC-26, HC-34 and HC-43 of UOP; KC2600/1, KC2602, KC2610, KC2702 and KC2710 of AKZO Nobel/Nippon Ketjen; and HYC 642 and HYC 652 of Procatalyse SA.

The effluent of the hydrocracker is separated into one or more of the above referred to fuels fractions and a full range residue. The full range residue is defined as the bottoms product of the distillation of the effluent of step (a) at atmospheric conditions. Preferably the full range residue boils predominately above 340° C. With boiling predominately above 340° C. is especially meant that more than 80 wt % boils above 340° C. Because a substantial fraction of the full range residue may boil in the gas oil range a considerable amount of gas oil is recovered after dewaxing having a excellent cold flow properties. It has also been found that when the MTW based catalyst is used in step (c) a relatively high selectivity is achieved to gas oil in comparison to when other dewaxing catalyst are used. This is one of the key advantages of the present invention. According to the present invention between 10 and 40 wt % of the dewaxed oil boils in the heavy gas oil range being between from 350 to 400° C. It must be understood that the dewaxed oil also comprises lower boiling gas oil components.

The final boiling point of the residue will be partly determined by the final boiling point of the feed to step (a) and may be far greater than 700° C. up to values of which cannot be determined by means of the standard test methods.

Thus, the full range residue as obtained in step (b) and used as feed to step (c) will not have been subjected to a distillation step wherein compounds boiling above 420° C. have been separated from the residue. This is advantageous because it eliminates the need for such a distillation unit in this part of the process.

Optionally part of the full range residue as obtained in step (a) may be recycled to step (a) as for example described in EP-A-0994173, which publication is incorporated by reference. Optionally the residue may be recycled to only the hydrocracking step of step (a) as for example described in EP-B-0699225, which publication is incorporated by reference. Preferably less than 15 wt % of the residue is recycled to step (a) and more preferably no residue is recycled to step (a). It has been found that good quality base oils may be prepared having a good quality without having to perform such a recycle. The feed to step (c) comprises the full range residue as obtained in step (b) and optionally a partly isomerised paraffin wax, also referred to as waxy raffinate, as obtained in a Fischer-Tropsch or Gas-to-Liquids Process. Such a waxy Raffinate may be prepared according the process as described in WO-02070630, which publication is incorporated herein by reference. Addition of such a Waxy Raffinate stream is advantageous to increase the viscosity index of the base oils in situations wherein the mineral source feed to step (a) is too poor to yield the desired viscosity index of the base oil grades. Adding Waxy Raffinate is also advantageous because the potential viscosity index of the residue may be lower thereby allowing less severe hydroprocessing conditions, i.e. at lower conversions, in step (a). This in turn will result in a higher base oil yield on mineral source feed to step (a). Up to 60 wt % of the feed to step (c) may advantageously comprise of this waxy Raffinate.

Optionally a noble metal guard bed may be positioned just upstream the dewaxing catalyst bed in the dewaxing reactor in order to remove any remaining sulphur and especially nitrogen compounds. An example of such a process is described in WO-A-9802503, which reference is hereby incorporated by reference.

The catalyst composition of the catalyst used in step (c) comprises a Group VIII metal and a zeolite of the MTW type. Preferably the catalyst also comprises of a binder.

Examples of MTW type zeolites are ZSM-12 as described in U.S. Pat. No. 3,832,449, CZH-5 as described in GB-A-2079735, Gallosilicate MTW as described in Y. X. Zhi, A. Tuel, Y. Bentaarit and C. Naccache, Zeolites 12, 138 (1992), Nu-13(5) as described in EP-A-59059, Theta-3 as described in EP-A-162719, TPZ-12 as described in U.S. Pat. No. 4,557,919 and VS-12 as described in K. M. Reddy, I. Moudrakovski and A. Sayari, J. Chem. Soc., Chem. Commun. 1994, 1491 (1994). The average crystal size of the zeolite is preferably smaller than 0.5 μm and more preferably smaller than 0.1 μm as determined by the well-known X-ray diffraction (XRD) line broadening technique using the high intensity peak at about 20.9 2-theta in the XRD diffraction pattern.

The binder in the catalyst may be any binder usually used for such an application. A possible binder includes alumina or alumina containing binders. Applicants have found that low acidity refractory oxide binder material that is essentially free of alumina provides more improved catalyst. Examples are low acidity refractory oxides such as silica, zirconia, titanium dioxide, germanium dioxide, boria and mixtures of two or more of these. The most preferred binder is silica. The weight ratio of the molecular sieve and the binder can be anywhere between 5:95 and 95:5. Lower zeolite content, suitable between 5 and 35 wt %, is advantageous for achieving an even higher selectivity.

The silica to alumina molar ratio of the zeolite prior to dealumination is preferably larger than 50 and more preferably between 70 and 250 and most preferably between 70 and 150. Preferably the zeolite has been subjected to a dealumination treatment. The dealumination of the zeolite results in a reduction of the number of alumina moieties present in the zeolite and hence in a reduction of the mole percentage of alumima. The expression "alumina moiety" as used in this connection refers to an $Al_2O_3$-unit which is part of the framework of the aluminosilicate zeolite, i.e. which has been incorporated via covalent bindings with other oxide moieties, such as silica ($SiO_2$), in the framework of the zeolite. The mole percentage of alumina present in the aluminosilicate zeolite is defined as the percentage of moles $Al_2O_3$ relative to the total number of moles of oxides constituting the aluminosilicate zeolite (prior to dealumination) or modified molecular sieve (after dealumination). Preferably dealumination is performed such that the reduction in alumina moieties in the framework is between 0.1 and 20%.

Dealumination may be performed by means of steaming. Preferably the surface of the zeolite crystallites are selectively dealuminated. A selective surface dealumination results in a reduction of the number of surface acid sites of the zeolite crystal lites, whilst not affecting the internal structure of the zeolite crystallites. When applying a surface dealumination the reduction of alumina moieties in the framework will be lower and preferably between 0.1 and 10%. Dealumination using steam results is a typical non-selective dealumination technique.

Dealumination can be attained by methods known in the art. Particularly useful methods are those, wherein the dealumination selectively occurs, or anyhow is claimed to occur selectively, at the surface of the crystallites of the molecular sieve. Examples of dealumination processes are described in WO-A-9641849. U.S. Pat. No. 5,015,361 describes a method wherein the zeolites are contacted with sterically hindered amine compound.

Preferably dealumination is performed by a process in which the zeolite is contacted with an aqueous solution of a fluorosilicate salt wherein the fluorosilicate salt is represented by the formula:

(A)2/bSiF6 wherein 'A' is a metallic or non-metallic cation other than H+having the valence 'b'. Examples of cations 'b' are alkylammonium, NH4+, Mg++, Li+, Na+, K+, Ba++, Cd++, Cu+, Ca++, Cs+, Fe++, Co++, Pb++, Mn++, Rb+, Ag+, Sr++, Tl+, and Zn++. Preferably 'A' is the ammonium cation. The zeolite material may be contacted with the fluorosilicate salt at a pH of suitably between 3 and 7. Such a dealumination process is for example described in U.S. Pat. No. 5,157,191. The dealumination treatment is also referred to as the AHS-treatment.

The catalyst composition is preferably prepared by first extruding the zeolite with the low acidity binder and subsequently subjecting the extrudate to a dealumination treatment, preferably the AHS treatment as described above. It has been found that an increased mechanical strength of the catalyst extrudate is obtained when prepared according to this sequence of steps.

It is believed that by maintaining the acidity of the catalyst at a low level conversion to products boiling outside the lube boiling range is reduced. Applicants found that the catalyst should have an alpha value below 50 prior to metals addition, preferably below 30, and more preferably below 10. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 sec−1). The alpha test is described in U.S. Pat. No. 3,354,078 and in J. Catalysis, 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in J. Catalysis, 61, 395 (1980).

The Group VIII metal may be nickel or cobalt or more preferably a noble metal Group VIII metal. Preferred noble Group VIII metals are palladium and more preferably platinum. The total amount platinum or palladium will suitably not exceed 10% by weight calculated as element and based on total weight of the catalyst, and preferably is in the range of from 0.1 to 5.0% by weight, more preferably from 0.2 to 3.0% by weight. If both platinum and palladium are present, the weight ratio of platinum to palladium may vary within wide limits, but suitably is in the range of from 0.05 to 10, more suitably 0.1 to 5. Catalysts comprising palladium and/or platinum as the hydrogenation component are preferred. Most preferred is when platinum is used as the sole hydrogenation component. The hydrogenation component is suitably added to the catalyst extrudate comprising the dealuminated aluminosilicate zeolite crystallites by known techniques.

The process conditions used in step (c) are preferably typical catalytic dewaxing process conditions involving operating temperatures in the range of from 200 to 500° C., preferably from 250 to 400° C., more preferably between 300 and 380° C., hydrogen partial pressures in the range of from 10 to 200 bar preferably from 30 to 150 bar, more preferably from 30 to 60 bar. Weight hourly space velocities (WHSV) in the range of from 0.1 to 10 kg of oil per liter of catalyst per hour (kg/l/hr), preferably from 0.2 to 5 kg/l/hr, more preferably from 0.5 to 3 kg/l/hr and hydrogen to oil ratios in the range of from 100 to 2,000 liters of hydrogen per liter of oil. The pour point of the base oil grades will vary depending their viscosity. The pour point of the various grades will also be dependent on the dewaxing severity in step (c) and will preferably be between −40 and −10° C.

Prior to performing step (d) the effluent or part of the effluent of step (c) is preferably subjected to a hydrofinishing step (c2). Preferably the entire effluent of step (c) is subjected to a hydrofinishing step. Alternatively one may separate the lower viscous grades, especially the gas oil and optionally also the spindle oil, from the effluent of step (c) and perform step (c2) exclusively on the fraction comprising the more viscous grades. It has been found that the lower viscous grades do not always require a hydrofinishing step to obtain a water white oil or gas oil having the desired long term stability. Optionally the gas oil and the fractions boiling below said gas oil are topped from the effluent of step (c) in a simple distillation column. This is advantageous because it enables one to process a full range residue comprising a larger portion of low boiling compounds, boiling in the (vacuum) gas oil range, without having to install for example a hydrofinishing reactor for these fractions. This because the extra gas oil fraction in the effluent of step (c) is separated from said effluent before performing hydrofinishing step (c2).

The hydrofinishing step is to improve the quality of the dewaxed fraction. In this step lube range olefins are saturated, heteroatoms and colour bodies are removed and if the pressure is high enough residual aromatics are saturated. Preferably the conditions are so chosen to obtain a base oil grade comprising more than 95 wt % saturates and more preferably such that a base oil is obtained comprising more than 98 wt % saturates. The hydrofinishing step is suitable carried out at a temperature between 230 and 380° C., a hydrogen partial pressure of between 10 to 250 bar and preferably above 100 bar and more preferably between 120 and 250 bar. The WHSV (Weight hourly space velocity) ranges from 0.3 to 10 kg of oil per litre of catalyst per hour (kg/l.h).

The hydrofinishing step is suitably carried out in cascade with the dewaxing step. Thus the entire effluent of step (c) is fed to step (c2), without separating any products between said steps as also described above. For this reason the operating hydrogen partial pressure in the dewaxing step is determined by the required hydrogen partial pressure of the hydrofinishing step and thus preferably above 100 bar and more preferably between 120 and 250 bar.

The hydrofinishing or hydrogenation catalyst is suitably a supported catalyst comprising a dispersed Group VIII metal. Possible Group VIII metals are cobalt, nickel, palladium and platinum. Cobalt and nickel containing catalysts may also comprise a Group VIB metal, suitably molybdenum and tungsten.

Suitable carrier or support materials are low acidity amorphous refractory oxides. Examples of suitable amorphous refractory oxides include inorganic oxides, such as alumina, silica, titania, zirconia, boria, silica-alumina, fluorided alumina, fluorided silica-alumina and mixtures of two or more of these.

Suitable hydrogenation catalysts include those catalysts comprising as one or more of nickel (Ni) and cobalt (Co) in an amount of from 1 to 25 percent by weight (wt %), preferably 2 to 15 wt %, calculated as element relative to total weight of catalyst and as the Group VIB metal component one or more of in an amount of from 5 to 30 wt %, preferably 10 to 25 wt %, calculated as element relative to total weight of catalyst. Examples of suitable nickel-molybdenum containing catalyst are KF-847 and KF-8010 (AKZO Nobel) M-8-24 and M-8-25 (BASF), and C-424, DN-190, HDS-3 and HDS-4 (Criterion). Examples of suitable nickel-tungsten containing catalysts are NI-4342 and NI-4352 (Engelhard), C-454 (Criterion). Examples of suitable cobalt-molybdenum containing catalysts are KF-330 (AKZO-Nobel), HDS-22 (Criterion) and HPC-601 (Engelhard).

For hydrocracked feeds containing low amount of sulphur, as in the present invention, preferably platinum containing and more preferably platinum and palladium containing catalysts are used. The total amount of these noble Group VIII metal component(s) present on the catalyst is suitably from 0.1 to 10 wt %, preferably 0.2 to 5 wt %, which weight percentage indicates the amount of metal (calculated as element) relative to total weight of catalyst.

Preferred supports for these palladium and/or platinum containing catalysts are amorphous silica-alumina, whereby more preferably the silica-alumina comprises from 2 to 75 wt % of alumina. Examples of suitable silica-alumina carriers are disclosed in WO-A-9410263. A preferred catalyst comprises an alloy of palladium and platinum preferably supported on an amorphous silica-alumina carrier of which the commercially available catalysts C-624 and C-654 of Criterion Catalyst Company (Houston, Tex.) are examples.

Step (d) and (e) may be performed in one or more distillation columns operating at a reduced pressure. As explained above distillation may be performed in two stages wherein only the heavier part is subjected to a hydrofinishing step.

The different base oil grades may be obtained by withdrawing products along the distillation column, preferably using so-called side-strippers. Intermediate fractions may also be withdrawn in order to meet the volatility requirements of the desired base oil grades. Preferably gaseous tops, a liquid tops, a spindle oil, a light machine oil and a medium machine oil are obtained in step (d) and (e).

The liquid tops, boiling preferably and substantially below 400° C. as obtained in step (d) and (e) comprises naphtha, kerosene and gas oil fractions may be advantageously recycled to step (b) or be isolated as separate products. Because these products have been subjected to a catalytic dewaxing step and to an optional hydrofinishing step a fuel product is obtained having a very low content of aromatics, sulphur together with excellent low temperature properties. Especially a gas oil may be obtained in step (d) and (e) having a very low sulphur content of below 10 ppm, a low aromatics content of below 0.1 mmol/100 grams, excellent a cold flow properties like a pour point of below −30° C. and a cold filter plugging point of below −30° C. The gas oil also has excellent lubricity properties. This makes such a gas oil especially an excellent refinery blending component to blend low sulphur gas oil. The gas oil may also be used as a drilling mud fluid, an electrical oil, a cutting oil, an aluminium rolling oil or as a fruit spray oil.

The invention will be illustrated by the following non-limiting examples.

Preparation of the Dewaxing Catalyst

MTW Type zeolite crystallites were prepared as described in "Verified synthesis of zeolitic materials" as published in Micropores and mesopores materials, volume 22 (1998), pages 644-645 using tetra ethyl ammonium bromide as the template. The Scanning Electron Microscope (SEM) visual observed particle size showed ZSM-12 particles of between 1 and 10 μm. The average crystallite size as determined by XRD line broadening technique as described above was 0.05 μm. The crystallites thus obtained were extruded with a silica binder (25% by weight of zeolite, 75% by weight of silica binder). The extrudates were dried at 120° C. and calcined at 625° C. A solution of (NH4)2SiF6 (20 ml of 0.02 N solution per gram of zeolite crystallites) was poured onto the extrudates. The mixture was then heated at 90° C. during 5 hours. After filtration, the extrudates were washed twice with deionised water, dried at 120° C. and then calcined at 500° C.

The thus obtained extrudate was impregnated with an aqueous solution of platinum tetramine nitrate and drying and calcining in a rotary kiln at 300° C. The resulting catalyst comprised 0.7% by weight Pt supported on the dealuminated, silica-bound MTW zeolite.

The catalyst was activated in-situ by reduction of the platinum under a hydrogen rate of 100 l/hr at a temperature of 350° C. for 2 hours.

Example 1

A full range residue as obtained in a hydrocracking process, having the properties as listed in Table 1 was contacted with the silica bound Pt-MTW catalyst as described above in the presence of hydrogen at three different temperatures as specified in Table 2, an outlet pressure of 140 bar, a WHSV of 1 kg/l.hr and a hydrogen gas rate of 750 Nl/kg feed.

The liquid effluent having a pour point of −19° C. was separated into a heavy gas oil product and three base oil grades of which properties are listed in Table 2.

TABLE 1

| Full range residue | | |
|---|---|---|
| Pour point | | 42° C. |
| Density at 70° C. | | 819.3 |
| Refractive index at 70° C. | | 1.4530 |
| Vk 100° C. (a) | | 4.786 cSt |
| S | | <1 mg/kg |
| N | | <1 mg/kg |
| Aromatics UV (SMS 2714 method) | mmol/100 g | |
| Monos | " | 28.7 |
| Naphthalenes | " | 3.49 |
| Phenantrenes | " | 1.75 |
| Chrysenes | " | 0.589 |
| Tetraphenes | " | 1.242 |
| TBP-GLC | | |
| IBP | ° C. | 182 |
| 10 | " | 341 |
| 50 | " | 434 |
| 90 | " | 528 |
| 95 | " | 552 |
| 99 | " | 589 |
| FBP | " | 600 |

(a) kinematic viscosity at 100° C.

TABLE 2

| | | HEAVY GAS OIL | SPINDLE OIL | LIGHT MACHINE OIL | MEDIUM MACHINE OIL |
|---|---|---|---|---|---|
| Distillation step | | 400° C.– | 400° C.–440° C. | 440° C.–470° C. | 470° C.+ |
| % m on feed (from TBP GLC) | | 38.30 | 21.32 | 13.42 | 25.66 |
| Pour point | ° C. | −35 | −20 | −14 | −5 |
| Vk 40 (b) | cSt | 5.208 | 21.96 | 36.27 | 96.12 |
| Vk 100 (b) | cSt | 1.754 | 4.395 | 6.083 | 11.56 |
| VI | | nd | 109 | 114 | 108 |

(b) kinematic viscosity at 40° C. or 100° C. resp.

Example 2

Example 1 was repeated except at a reactor temperature of 347° C. The liquid effluent having a pour point of −29° C. was separated into a heavy gas oil product and three base oil grades of which properties are listed in Table 3.

TABLE 3

| | | HEAVY GAS OIL | SPINDLE OIL | LIGHT MACHINE OIL | MEDIUM MACHINE OIL |
|---|---|---|---|---|---|
| Distillation step | | 400° C.– | 400° C.–440° C. | 440° C.–470° C. | 470° C.+ |
| % m on feed (from TBP GLC) | | 41.10 | 19.87 | 12.47 | 23.96 |
| Pour point | ° C. | −39 | −32 | −25 | −22 |
| Vk 40 | cSt | 4.523 | 22.96 | 35.56 | 95.76 |
| Vk 100 | cSt | 1.602 | 4.462 | 5.955 | 11.34 |
| VI | | nd | 105 | 111 | 105 |

Example 3

Example 1 was repeated except at a reactor temperature of 350° C. The liquid effluent having a pour point of −38° C. was separated into a heavy gas oil product and three base oil grades of which properties are listed in Table 4

TABLE 4

| | | HEAVY GAS OIL | SPINDLE OIL | LIGHT MACHINE OIL | MEDIUM MACHINE OIL |
|---|---|---|---|---|---|
| Distillation step | | 400° C. minus | 400° C.–440° C. | 440° C.–470° C. | 470° C.+ |
| % m on feed (from TBP GLC) | | 23.96 | 18.82 | 11.74 | 22.80 |
| Pour point | ° C. | −51 | −38 | −35 | −24 |
| Vk 40 | cSt | 3.884 | 23.39 | 37.85 | 102.6 |
| Vk 100 | cSt | 1.455 | 4.439 | 6.031 | 11.71 |
| VI | | nd | 98 | 105 | 102 |

nd = not determined

Comparative Example A

Experiment 1 was repeated except that a catalyst based on ZSM-5 was used. The results of this experiment 10 are presented in FIG. 1 (straight line). Also in FIG. 1 the results as presented in Table 2 are presented. The X-axis represents the mid boiling point of the base oil grade. The open triangles are the results of Example 1, the open boxes are the results of Example 2 and the open diamonds are a result of Example 3. The FIGURE shows that for the lower viscosity grades the ZSM-5 based catalyst results in a pour point give-away. A more flat pour point profile is obtained for Examples 1-3 according the invention.

That which is claimed is:

1. A continuous process for simultaneously preparing multiple grades of base oil products and middle distillates from a mineral crude derived feed, wherein said process comprises the following steps:

(a) hydrocracking a mineral crude derived feed, comprising a vacuum gas oil having more than 10 wt % compounds present therein boiling above 470° C., utilizing a hydrocracking catalyst comprising an acidic large pore size zeolite within a porous support material with an added metal having a hydrogenation/dehydrogenation function, wherein said added metal is a Group VIII/Group VIB combination, to thereby provide a conversion level of between 15 and 90 wt % and obtaining an effluent;

(b) distilling the effluent as obtained in step (a) into at least one middle distillate product and a full range residue boiling substantially above 340° C. but without separating compounds boiling above 420° C. from said full range residue;

(c) catalytically dewaxing the entire full range residue as obtained in step (b) by contacting the full range residue with a dewaxing catalyst comprising a dealuminated extrudate of a zeolite of the MTW type and a low acidity refractory binder material wherein the weight ratio of said zeolite to said low acidity refractory binder material is in the range of from 5:95 to 95:5 and a Group VIII metal of either platinum or palladium that is present in said dewaxing catalyst in the range of from 0.1 to 5.0% by weight, thereby obtaining a dewaxed oil;

(d) hydrofinishing at least part of the dewaxed oil obtained in step (c) to provide a hydrofinished, dewaxed oil;

(e) distilling the hydrofinished, dewaxed oil obtained in step (d) to simultaneously provide multiple grades of base oil products; and (f) isolating a dewaxed gas oil from the dewaxed oil as obtained in step (c), wherein the dewaxed heavy gas oil obtained in step (c) comprises between 10 and 40 wt % of a dewaxed heavy gas oil boiling for more than 70 wt % between 370 and 400° C.

2. The process according to claim 1, wherein more than 20 wt % of the compounds present in the vacuum gas oil boils above 470° C.

3. The process according to claim 2, wherein at least a portion of the fraction boiling below the gas oil fraction is recycled to step (b) to be mixed with the effluent before distilling thereof.

4. The process according to claim 3, wherein from 0 to 15 wt % of the full range residue as obtained in step (b) is recycled to step (a) to be mixed with the mineral crude derived feed before hydrocracking thereof.

5. The process according to claim 4, further comprising adding a Fischer-Tropsch derived partly isomerised paraffin fraction to the full range residue prior to catalytically dewaxing.

6. The process according to claim 5, wherein the hydrogen partial pressure in step (c) is greater than 100 bars.

7. The process according to claim 1, wherein the multiple grades of base oil products simultaneously obtained in step (e) comprises a spindle oil, a light machine oil and a medium machine oil.

8. The process according to claim 1, wherein the zeolite content of the dewaxing catalyst is between 5 wt. % and 35 wt. %.

9. The process according to claim 8, wherein the low acidity refractory binder material is selected from silica, zirconia, titanium dioxide, germanium dioxide, boria, and mixtures of two or more thereof.

10. The process according to claim 9, wherein the zeolite of the dewaxing catalyst has an average crystal size smaller than 0.5 μm.

11. The process according to claim 10, wherein the dewaxing catalyst, prior to metals addition, has an alpha value below 50.

12. The process according to claim 11, wherein the low acidity refractory binder material is silica and is essentially free of alumina.

13. A continuous process for simultaneously preparing multiple grades of base oil products and middle distillates from a mineral crude derived feed, where said process comprises:

hydrocracking a mineral crude derived feed, comprising a vacuum gas oil having more than 10 wt % compounds present therein boiling above 470° C., using a hydrocracking catalyst, comprising an acidic large pore zeolite, a porous support material, and added metal having a hydrogenation/dehydrogenation function, wherein said added metal is a Group VIII/Group VIB combination, to thereby provide a conversion level of between 15 and 90 wt % and obtaining a hydrocracker effluent;

distilling said hydrocracker effluent into a middle distillate product and a full range residue product having a property such that more than 80 wt % boils above 340° C. and wherein compounds boiling above 420° C. are not separated from said full range residue product;

catalytically dewaxing said full range residue product by contacting said full range residue product with a dewaxing catalyst comprising a dealuminated extrudate of a zeolite of the MTW type and a low acidity refractory binder material, wherein said dealuminated extrudate has a weight ratio of said zeolite to said low acidity refractory binder material in the range of from 5:95 to 95:5, and a Group VIII metal of either platinum or palladium that is present in said dewaxing catalyst in the range of from 0.1 to 5.0% by weight, to thereby obtain a dewaxed oil;

distilling the dewaxed oil obtained in step (c) to remove a gas oil fraction and a fraction boiling below the gas oil fraction, which is below 400° C.;

hydrofinishing the dewaxed oil from which the as oil fraction and fraction boiling below the as oil fraction has been removed to provide a dewaxed, hydrofinished oil distilling the hydrofinished, dewaxed oil to simultaneously provide multiple grades of base oil products; and isolating a dewaxed gas oil from the dewaxed oil as obtained in step (c), wherein the dewaxed heavy gas oil obtained in step (c) comprises between 10 and 40 wt % of a dewaxed heavy gas oil boiling for more than 70 wt % between 370 and 400° C.

14. A process according to claim 13, wherein the zeolite content of the dewaxing catalyst is between 5 wt. % and 35 wt. %.

15. A process according to claim 14, wherein the low acidity refractory binder material is selected from silica, zirconia, titanium dioxide, germanium dioxide, boria, and mixtures of two or more thereof.

16. A process according to claim 15, wherein the zeolite of the dewaxing catalyst has an average crystal size smaller than 0.5 μm.

17. A process according to claim 16, wherein the dewaxing catalyst, prior to metals addition, has an alpha value below 50.

18. A process according to claim 17, wherein the low acidity refractory binder material is silica and is essentially free of alumina.

19. A process according to claim 18, wherein up to 15 wt % of said full range residue product is recycled to be mixed with said mineral crude derived feed.

20. A process according to claim 19, further comprising adding a Fischer-Tropsch derived partly isomerised paraffin fraction to the full range residue prior to catalytically dewaxing.

* * * * *